United States Patent [19]

Westveer

[11] Patent Number: 4,489,642

[45] Date of Patent: Dec. 25, 1984

[54] METHOD AND APPARATUS FOR REDUCING OPERATING NOISE IN AXIAL PISTON PUMPS AND MOTORS

[75] Inventor: Robert C. Westveer, Kalamazoo, Mich.

[73] Assignee: General Signal Corporation, Stamford, Conn.

[21] Appl. No.: 457,794

[22] Filed: Jan. 13, 1983

[51] Int. Cl.[3] ..... F04B 1/20; F01B 13/06

[52] U.S. Cl. ..... 91/499; 417/53; 91/6.5

[58] Field of Search ..... 91/499, 488, 6.5; 417/53

[56] References Cited

U.S. PATENT DOCUMENTS

| | | | |
|---|---|---|---|
| 3,094,078 | 6/1963 | Brueder | 91/499 |
| 3,858,483 | 1/1975 | Hein | 91/486 |
| 4,007,663 | 2/1977 | Nagatomo | 91/488 |
| 4,096,786 | 6/1978 | Schauer | 91/499 |

FOREIGN PATENT DOCUMENTS

| | | | |
|---|---|---|---|
| 2253419 | 5/1974 | Fed. Rep. of Germany | 91/486 |
| 2837178 | 3/1980 | Fed. Rep. of Germany | 91/499 |
| 684551 | 12/1952 | United Kingdom | 91/499 |
| 1340793 | 7/1972 | United Kingdom | 91/488 |

*Primary Examiner*—William L. Freeh

*Attorney, Agent, or Firm*—Pollock, Vande Sande & Priddy

[57] ABSTRACT

A method and an apparatus are disclosed for reducing operating noise in axial piston pumps and motors. An elongated passage (88, 98) connects the outlet plenum (86) of the apparatus directly with each cylinder (30) during its discharge stroke, the passage being positioned between the point (68) at which the discharge stroke begins and the leading edge (78) of the discharge port (74) of the apparatus and the length and cross-section of the passage being sufficient to permit gradual attenuation of any pressure differential between each cylinder and the outlet plenum before the cylinder opens to the discharge port leading to the outlet plenum. See FIGS. 1 and 2.

21 Claims, 4 Drawing Figures

FIG. 2
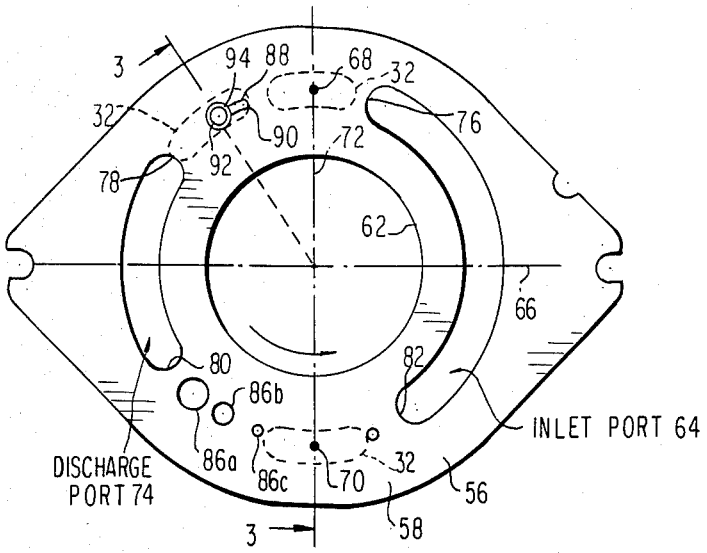
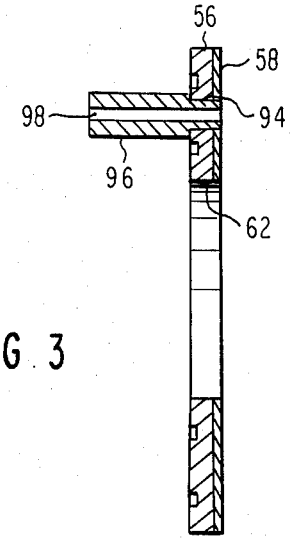
FIG. 3
FIG. 4
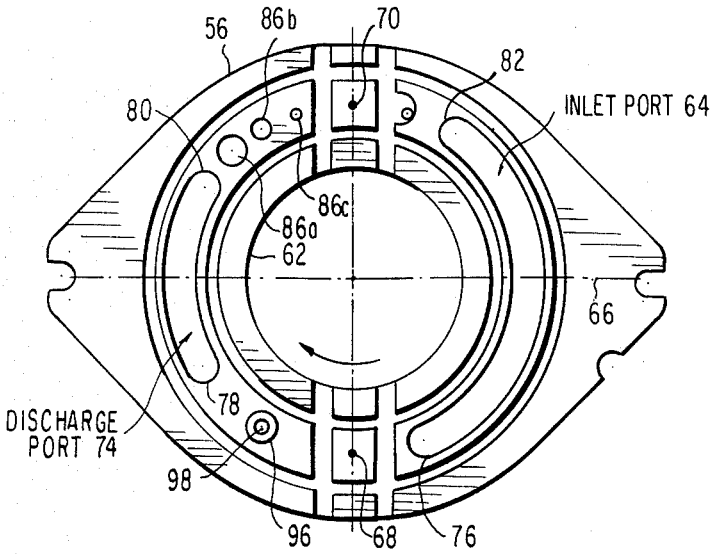

METHOD AND APPARATUS FOR REDUCING OPERATING NOISE IN AXIAL PISTON PUMPS AND MOTORS

DESCRIPTION

1. Technical Field

The present invention concerns axial piston pumps and motors. Particularly, the invention concerns a method and apparatus for reducing operating noise in such apparatuses.

2. Background Art

Axial piston hydraulic pumps and motors have been used for many years. In such apparatuses, a cylinder block is mounted for rotation on a shaft within a housing. The block comprises a plurality of cylinders arranged around and parallel to the axis of the shaft. Piston assemblies in the cylinders are universally coupled at their rod ends to an angled cam plate or swash plate, so that upon rotation of the cylinder block the pistons are caused to reciprocate in their cylinders, thus creating a pumping or motoring action. The cam plate may be fixed at one angle which produces a fixed displacement or may be variable over a range of angles which produce a variable displacement. Depending on the speed of operation of a pump of this type, the cam angle, the inlet pressure, the liquid being pumped and other factors, the pressure at the end of the inlet stroke may be at or even somewhat less than atmospheric, the usual inlet pressure.

The discharge stroke of each piston begins as the piston assembly rotates with the cylinder block past the point of the cam furthest from the cylinder block. As the piston moves outward in its cylinder, the pressure of the liquid in the cylinder rises at a rate dependent upon the speed of rotation of the shaft and the angle of the cam. In many applications of such pumps, the inlet pressure is at or near atmospheric; but the discharge pressure may be as high as several thousand pounds per square inch. Since the discharge port of the pump opens to each cylinder not long after the discharge stroke begins, the rather low pressure in each cylinder and the very high pressure in the discharge plenum of the pump begin to equalize almost instantaneously. A shock wave is generated in the liquid which is transmitted to the body of the pump, thus contributing the most significant component of the operating noise of the pump. For some years it has been recognized that reduction of the magnitude of this shock wave or pulse is the key to more quiet pump operation.

A variety of techniques have been tried for reducing pump noise. Lowering the discharge pressure or the pump speed or both helps reduce the magnitude of the shock wave, but leads to less efficient operation. Increasing the mass of the pump structure or adding sound insulation is also helpful, but increases the cost and bulkiness of the unit. Other designers have attempted with varying degrees of success to modify the structure of the pump to achieve some noise reduction without reducing displacement, operating pressure or speed. A common technique is to provide a metering groove in the contact surface of a port or valve plate which engages the rotating cylinder block and separates the inlet and discharge sides of the pump. Such a groove typically extends from the leading edge of the discharge port back toward the point at which the discharge stroke begins. However, to prevent leakage from the pump inlet directly to the outlet, the metering groove must terminate at a point where it cannot communicate with a cylinder until the cylinder has passed the inlet port of the pump and, preferably, its piston has begun its discharge stroke.

In theory, as the piston begins its discharge stroke, liquid can flow through the metering groove between each cylinder and the outlet port to attenuate, at least partially, any pressure differential. In practice, however, two adjacent cylinders are usually open to the groove at least part of the time, which tends to choke off flow through the groove and minimize pressure equalization in the trailing cylinder. As a result, relatively modest reductions in pump noise have been achieved except in a rather narrow range of pump displacement, speed and pressure, for a given metering groove geometry. And due to the previously mentioned constraint on the area of the valve plate in which the metering groove must be located, the designers' options are limited for reducing noise with such grooves. In place of and sometimes in addition to such metering grooves, small but progressively larger ports have been provided through the valve plate to the outlet plenum at locations between the point at which the discharge stroke begins and leading edge of the primary discharge port. Such ports appear to have had little influence on noise reduction.

Though many efforts have been made to quiet axial piston hydraulic motors and pumps, most have been successful only over a narrow range of displacement and pressure or have required sacrifices in efficiency, weight or volume. A need has continued to exist for a technique for quieting such pumps and motors which is simple yet effective to significantly reduce noise over a wide range of operating conditions.

DISCLOSURE OF THE INVENTION

The primary object of the present invention is to provide an improved method and apparatus for reducing the operating noise of axial piston hydraulic pumps and motors.

A further object of the invention is to provide such a method and apparatus which are not constrained significantly by available space on the valve plate of such devices and are effective over a considerable range of operating pressures and displacements.

Another object of the invention is to provide such a method and apparatus which are effective to reduce noise but do not require extensive modification of existing pumps and motors.

Still another object of the invention is to provide such a method and apparatus which can be readily modified to reduce noise over various ranges of operating pressures and displacements.

These objects are given only by way of example. Thus, other desirable objectives or advantages inherently achieved by the disclosed structure may be perceived by or become apparent to those skilled in the art. Nonetheless, the scope of the invention is to be limited only by the appended claims.

The invention concerns an improved type of valve member for use in the types of pumps and motors previously described, and a method of operating a pump or motor comprising such a valve member. Preferably, the valve member comprises a plate-like element which may be a separate piece or formed integrally with the body or a closure of the pump or motor. On one side of an axis separating the inlet and outlet plenums of the apparatus is an inlet port which extends through the element to communicate with the inlet plenum on one side and the rotating cylinders on the other. On the other side of the axis is a discharge port which extends through the element to communicate with the discharge plenum on one side and rotating cylinders on the other. Between the discharge port and the axis at the initial portion of the discharge stroke is a pressure attenuator means for providing an elongated flow path for conveying hydraulic fluid from the cylinders through the plate-like element to the discharge plenum. The length and cross-section of the flow path are chosen to permit gradual attenuation of a pressure differential between each successive cylinder and the discharge plenum. As a result, the operating noise level of the apparatus is greatly reduced.

In the preferred embodiment, the pressure attenuator means comprises a closed-ended metering groove in the surface of the valve element facing the cylinder block and an elongated attenuation conduit extending into the groove from the other side of the valve element. The metering groove preferably communicates with one cylinder at a time, but may be longer, if desired.

BRIEF DESCRIPTION OF THE DRAWINGS

FIG. 2 shows a bottom view of a separate, plate-like valve element according to the invention, taken along line 2—2 of FIG. 1. The outlines of three cylinder ports have been superimposed in phantom for illustrative purposes.

FIG. 3 shows a section view taken along line 3—3 of FIG. 2.

FIG. 4 shows a top view of a separate, plate-like valve element according to the invention, taken along line 4—4 of FIG. 1.

BEST MODE FOR CARRYING OUT THE INVENTION

Figure 1:
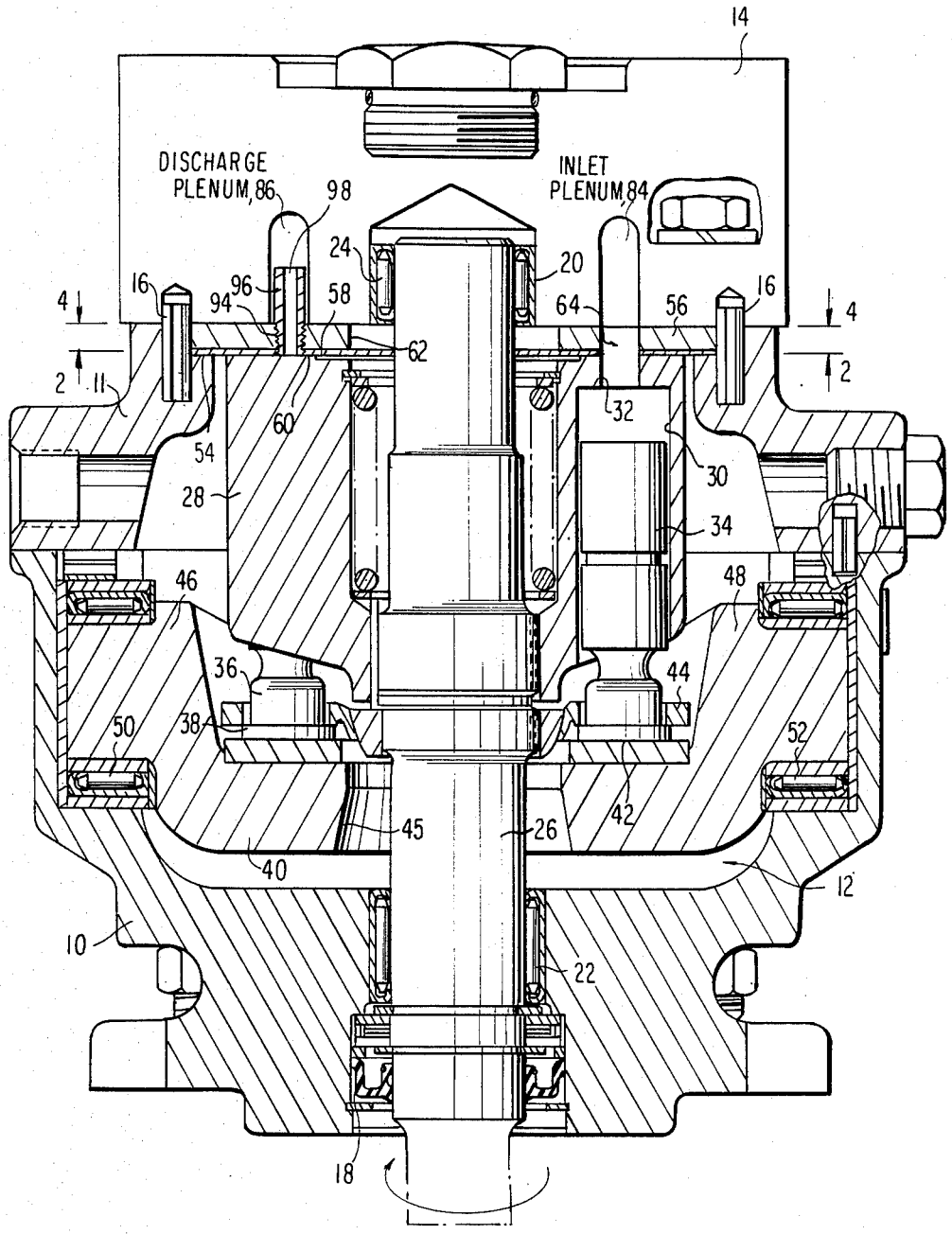
FIG. 1 shows an elevation view, primarily in section, of an axial piston pump embodying the invention. For purposes of illustration, the attenuator conduit 96 extending into the discharge plenum 86 has been rotated into view.

The following is a detailed description of a preferred embodiment of the invention, reference being made to the drawings in which like reference numerals identify like elements of structure in each of the several Figures.

FIG. 1 shows an axial piston hydraulic pump embodying the present invention. The housing of the apparatus comprises a lower adapter body 10 roll pinned to an upper body 11 to define an interior chamber 12. At its upper end, as illustrated, chamber 12 is closed by a cover 14 positioned by means such as roll pins 16, to complete the housing. A stepped bore 18 at the lower end of adapter body 10 and a blind bore 20 in the underside of cover 14 retain bearings 22, 24 on which the drive shaft 26 of the pump rotates. In the illustrated embodiment, shaft 26 rotates clockwise when viewed from the upper end of the shaft, as illustrated; however, those skilled in the art will understand that pumps or motors rotating counterclockwise also can be configured in accordance with the invention.

Within chamber 12, a cylinder block 28 is mounted for rotation with shaft 26. Block 28 comprises a plurality, for example nine, of axially extending through cylinders 30, only one of which appears in FIG. 1. In the familiar fashion, cylinders 30 are equally spaced about the rotational axis of shaft 26. At its upper end, as illustrated, each cylinder 30 terminates in a cylinder port 32, which is more or less kidney shaped and extends along an arc reaching from one side of the cylinder to the other as will be understood by those skilled in the art. See FIG. 2. Within each cylinder is an axially reciprocable piston assembly 34 having at its lower end a universal joint 36 which is connected to a sliding cam follower foot 38. Beneath the cam follower feet 38 is a cam or swash plate 40 having a circular wear surface or track 42 on which cam follower feet 38 are held by a retaining plate 44, all in the familiar fashion. Cam plate 40 comprises a central opening 45 through which shaft 26 passes and a pair of diametrically opposite stub shafts 46, 48 rotatably supported on trunnion bearings 50, 52. Conventional means, not illustrated, may be used to change the angle of cam plate 40 relative to the axis of shaft 26, so that the displacement of the pump can be varied from zero when the plane of track 42 is perpendicular to the shaft, to a maximum when cam plate 40 has rotated to the limit of movement of joints 36. Of course, a fixed angle cam plate can be used without departing from the scope of the invention.

At the upper end of upper body 11, a recess 54 is provided which receives a plate-like valve element 56 of the type shown in FIGS. 2–4. The underside 58 of valve element 56 preferably is bronzed and machined to provide a suitable stationary wear surface for contacting the upper surface 60 of rotating cylinder block 28. A central bore 62 in valve element 56 surrounds shaft 26 in the assembled pump. Valve element 56 comprises an elongated, kidney-shaped inlet port 64 which extends, for example, over an angle of about 72°30′ on either side of horizontal axis 66, which is parallel to the rotational axis of cam plate 40 as shown in FIGS. 2 and 4. In the illustrated embodiment, the point 68 at which each piston assembly 34 reaches the end of its inlet stroke is at the top of valve element 56 as shown in FIG. 2; and at the bottom, as shown in FIG. 4. That is, at point 68, each piston assembly 34 has been withdrawn from its cylinder 30 to the maximum required by cam plate 40 and is about to begin its discharge stroke. The point 70 at which each piston assembly reaches the end of its discharge stroke is at the diametrically opposite side of valve element 56 as shown in FIGS. 2 and 4. At point 70, each piston assembly has been pushed toward its cylinder port 32 to the maximum required by cam plate 40 and is about to begin its inlet stroke. An axis 72 between points 68 and 70 separates the inlet and discharge sides of the pump. On the opposite side of axis 72, valve element 56 comprises an elongated kidney-shaped discharge port 74 which extends, for example, over angle of about 31° on either side of horizontal axis 66. To prevent leakage between the inlet and discharge sides of such pumps, the trailing edge 76 of inlet port 64 and the leading edge 78 of discharge port 74 must be spaced by an arc at least equal in length to the arc length of each cylinder port 32. The same minimum spacing must be maintained between the trailing edge 80 of discharge port 74 and the leading edge 82 of inlet port 64.

Inlet port 64 opens into a similarly kidney-shaped but larger volume inlet plenum 84 into which low pressure hydraulic fluid is admitted through conduits not illustrated. Discharge port 74 opens into a similarly kidney-shaped but larger volume discharge plenum 86 from which high pressure hydraulic fluid is delivered through conduits not illustrated. During operation, the pressure differential from inlet to discharge often is several thousand pounds per square inch in a typical hydraulic system. Although valve element 56 preferably is formed as a separate plate-like structure, those skilled in the art will appreciate that a suitable valve member also may comprise an integral part of either upper body 11 or cover 14, without departing from the scope of the present invention.

In a pump embodying the structure thus far described, the pressure in each cylinder 30 begins to rise as the cylinder moves away from point 68 and piston assembly 34 begins to move toward discharge port 32. Before the cylinder moves away from point 68, its pressure may be at or even slightly below inlet pressure depending on pump speed, cam angle, inlet pressure and related factors. If no provision were made for gradually equalizing the pressure in each cylinder with that acting at discharge port 74, the previously described shock wave would occur and the pump would produce a great deal of noise, particularly if the pump pressure were quite high. If a metering groove were provided in surface 58 extending back from leading edge 78 toward point 68, some benefit would be obtained over a limited range of pump displacement, pressure and speed; however, the pump would still be quite noisy. Since the discharge flow rate is low at the beginning and end of the discharge stroke, it is known to shorten discharge port 74 in the manner illustrated and to provide graduated circular ports such as 86*a*, 86*b*, 86*c* at both ends of the discharge port, though only ports at the trailing edge of the discharge port are shown. However, such graduated ports have little effect on the noise level of the pump.

In accordance with the present invention, a closed-ended metering slot 88 is provided in surface 58. The leading edge 90 of slot 88 must be no closer to point 68 than one-half the arc length of a cylinder port 32 in order to prevent leakage from inlet to outlet, as previously mentioned. In the preferred embodiment, the arc length of metering slot 88 from leading edge 90 to trailing edge 92 should not exceed the arc length of the minimum spacing between cylinder ports 32, thus preventing simultaneous exposure of metering groove 88 to two cylinder ports. This ensures that flow from a leading cylinder into the metering groove will not interfere with pressure attenuation in a following or trailing cylinder, since two cylinders are never exposed to the groove at once, as in the prior art. Thus, each cylinder has more time for its pressure to reach discharge pressure than would have been the case in the prior art. However, longer metering slots also may be used without departing from the scope of the invention.

Preferably at trailing edge 92, a threaded bore 94 is provided from metering slot 88 through the thickness of valve element 56, directly into discharge plenum 86. An attenuator conduit 96 having a threaded lower end is screwed into bore 94, so that the interior bore 98 of conduit 96 provides an elongated flow path for attenuation of any pressure differential between discharge plenum 86 and each successive cylinder 30. Because conduit 96 extends into the discharge plenum, the combined lengths of bore 98 and metering groove 88 exceed the length of longest prior art type metering groove which could have been provided in surface 58 in the manner discussed previously. As a result, the flow impedance of slot 88 and conduit 96 can be readily tailored to accommodate a wide range of operating conditions and still reduce noise quite significantly.

Subject to the previously mentioned restrictions on the location of leading edge 90 and the preferred maximum arc length of metering groove 88, trailing edge 92 preferably is positioned so that each cylinder port 32 opens to discharge port 74 when the pressure in the associated cylinder 30 is essentially equal to the discharge pressure of the pump. If trailing edge 92 is too far from leading edge 78, the cylinders 30 will tend to repressurize, leading to unwanted shock waves and higher noise levels than with the preferred arrangement.

The geometries of attenuator conduit 96 and metering groove 88 are dependent upon the desired range of pump displacements and pressures and the pump speed. In general, the length and cross-sectional areas should be small enough to provide adequate flow impedance to minimize the shock wave when the cylinder ports 32 first open into metering groove 88, where flow from discharge plenum 86 through bore 98 commonly occurs. On the other hand, the lengths and areas must be chosen to be large enough to permit flow directly to discharge plenum 86 without causing an excessive back pressure in each cylinder 30. This balancing of competing considerations has been found to ensure a gradual attenuation of a pressure differential between the cylinders and the discharge plenum, so that noise level is reduced very significantly.

In a nine piston, approximately 3.5 inch cylinder circle, six cubic inch per revolution pump operating at 1800 rpm with a 3800 psi discharge pressure, a metering groove having an arc length of about approximately 14°, a radial width of about 0.125 inch, an axial depth of about 0.125 inch and a leading edge 90 at about 22° from point 68, was combined with an attenuator conduit 96 having an interior bore 98 of approximately 1.0 inch length and about 0.125 inch interior diameter. A truly remarkable reduction in noise level of 14 $dB_A$ was achieved from 102 $dB_A$ to 88 $dB_A$. Such a reduction corresponds to a more than 75% reduction in the sound pressure generated by the pump. Prior to modification in accordance with the invention, the pump had a conventional metering groove in surface 58, extending toward point 68 from leading edge 78.

Industrial Applicability

Although the present invention has been disclosed with particular reference to axial piston hydraulic pumps, those skilled in the art will appreciate that the invention is also applicable to similar hydraulic motors in which essentially the same types of pressure transitions occur as the motor's cylinders move between the high pressure and the low pressure sides of the motor.

Having disclosed my invention in sufficient detail to enable those skilled in the art to make and use it, I claim:

1. An improved valve member for use in an axial piston hydraulic apparatus of the type including a housing having an interior chamber; a shaft extending through said chamber and mounted for rotation in said housing; a cylinder block mounted for rotation with said shaft and provided with a plurality of axially extending through cylinders having cylinder ports at one end of said block; a plurality of piston assemblies, one positioned for movement in each of said cylinders; cam means mounted to said housing and operatively connected to said piston assemblies at the other end of said block, for causing said piston assemblies to reciprocate in said cylinders when said block rotates with said shaft; an inlet plenum in said housing; and a discharge plenum in said housing, said valve member being fixed in operation between said block and said inlet and discharge plenums for controlling the flow of hydraulic liquid from said inlet plenum to said cylinders and from said cylinders to said discharge plenum, said valve member comprising:

a plate-like element having a thickness and an axis extending from a first point at which each of said pistons reaches the end of its inlet stroke to a second point at which each of said pistons reaches the end of its discharge stroke;

at least one inlet port extending through said element on the inlet side of said axis;

at least one discharge port extending through said element on the discharge side of said axis; and pressure attenuation means, extended through said element and positioned on the discharge side of said axis between said at least one discharge port and said first point, for providing an elongated flow path through the thickness of said element to convey hydraulic fluid between sequential trailing ones of said cylinders and said discharge plenum, flow through said elongated flow path being in parallel with flow from sequential leading ones of said cylinders through said at least one discharge port to said discharge plenum, said flow path having a length and a cross-section sufficient to permit gradual attenuation of a pressure differential between each said trailing cylinder and said discharge plenum, said gradual attenuation occurring before the cylinder port of each said trailing cylinder opens to said at least one discharge port of said element, whereby the operating noise level of said axial piston apparatus is reduced.

2. A valve member according to claim 1, wherein said length of said flow path exceeds the arc length between said first point and the leading edge of said discharge port minus one-half the arc length of one of said cylinder ports of said block, as measured about the axis of said shaft.

3. A valve member according to claim 1, wherein said plate-like element comprises a separate, removable valve plate adapted to be fixed in operation between said block and said inlet and discharge plenums.

4. A valve member according to claim 3, wherein said length of said flow path exceeds the arc length between said first point and the leading edge of said discharge port minus one-half the arc length of one of said cylinder ports of said block, as measured about the axis of said shaft.

5. A valve member according to claim 3, wherein said pressure attenuation means comprises a metering groove in the side of said member facing said block, the ends of said groove being spaced from said discharge port and said first point; a bore through said member into said groove; and an attenuation conduit attached to the opposite side of said member in communication with said bore to establish said flow path, said conduit extending into said discharge plenum.

6. A valve member according to claim 5, wherein the arc length of said metering groove is no greater than the arc spacing between said cylinder ports of said block, as measured about the axis of said shaft.

7. A valve member according to claim 5, wherein the arc length of said metering groove is greater than the arc spacing between said cylinder ports of said block, as measured about the axis of said shaft.

8. An improved valve member for use in an axial piston hydraulic apparatus of the type including a housing having an interior chamber; a shaft extending through said chamber and mounted for rotation in said housing; a cylinder block mounted for rotation with said shaft and provided with a plurality of axially extending through cylinders having cylinder ports at one end of said block; a plurality of piston assemblies, one positioned for movement in each of said cylinders; cam means mounted to said housing and operatively connected to said piston assemblies at the other end of said block, for causing said piston assemblies to reciprocate in said cylinders when said block rotates with said shaft; an inlet plenum in said housing; and a discharge plenum in said housing, said valve member being fixed in operation between said block and said inlet and discharge plenums for controlling the flow of hydraulic liquid from said inlet plenum to said cylinders and from said cylinders to said discharge plenum, said valve member comprising:

a plate-like element having a thickness and an axis extending from a first point at which each of said pistons reaches the end of its inlet stroke to a second point at which each of said pistons reaches the end of its discharge stroke;

at least one inlet port extending through said element on the inlet side of said axis;

at least one discharge port extending through said element on the discharge side of said axis; and pressure attenuation means, positioned on the discharge side of said axis between said at least one discharge port and said first point, for providing an elongated flow path through the thickness of said element to convey hydraulic fluid between sequential trailing ones of said cylinders and said discharge plenum, said pressure attenuation means comprising a metering groove in the side of said valve member facing said block, the ends of said metering groove being spaced from said at least one discharge port and said first point, a bore through said member from said discharge plenum into said groove; and an attenuation conduit attached to the opposite side of said member in communication with said bore to establish said flow path, said conduit extending into said discharge plenum so that flow through said flow path is in parallel with flow from sequential leading ones of said cylinders through said at least one discharge port to said discharge plenum, said flow path having a length and a cross-section sufficient to permit gradual attenuation of a pressure differential between each said trailing cylinder and said discharge plenum, said gradual attenuation occurring before the cylinder port of each said trailing cylinder opens to said at least one discharge port of said valve element, whereby the operating noise level of said axial piston apparatus is reduced.

9. A valve member according to claim 8, wherein the arc length of said metering groove is less than the arc spacing between said cylinder ports of said block, as measured about the axis of said shaft.

10. A valve member according to claim 8, wherein the arc length of said metering groove is greater than the arc spacing between said cylinder ports of said block, as measured about the axis of said shaft.

11. A method for reducing the operating noise level of rotary axial piston apparatuses of the type including a housing having an interior chamber; a shaft extending through said chamber and mounted for rotation in said housing; a cylinder block mounted for rotation with said shaft and provided with a plurality of axially extending through cylinders having cylinder ports at one end of said block; a plurality of piston assemblies, one positioned for movement in each of said cylinders; cam means mounted to said housing and operatively connected to said piston assemblies at the other end of said block, for causing said piston assemblies to reciprocate in said cylinders when said block rotates with said shaft; an inlet plenum in said housing; a discharge plenum in said housing; and a valve member fixed between said cylinder block and said inlet and discharge plenums and provided with inlet and discharge ports for controlling the flow of hydraulic liquid from said inlet plenum to said cylinders and from said cylinders to said discharge plenum, said method comprising the steps of:

providing an elongated flow path through said valve member to said discharge plenum at a location between said discharge port and a point at which each of said pistons reaches the end of its inlet stroke to convey hydraulic fluid between sequential trailing ones of said cylinders and said discharge plenum, flow through said elongated path being in parallel with flow from sequential leading ones of said cylinders through said at least one discharge port to said discharge plenum, the length and cross-section of said flow path being sufficient to permit gradual attenuation of a pressure differential between each cylinder and said discharge plenum said gradual attenuation occurring before the cylinder port of each cylinder opens to said discharge port of said element; and causing liquid to pass through said flow path during operation of said axial piston apparatus, whereby the operating noise level of said apparatus is reduced.

12. In a rotary axial piston apparatus of the type including a housing having an interior chamber; a shaft extending through said chamber and mounted for rotation in said housing; a cylinder block mounted for rotation with said shaft and provided with a plurality of axially extending through cylinders having cylinder ports at one end of said block; a plurality of piston assemblies, one positioned for movement in each of said cylinders; cam means mounted to said housing and operatively connected to said piston assemblies at the other end of said block, for causing said piston assemblies to reciprocate in said cylinders when said block rotates with said shaft; an inlet plenum in said housing; a discharge plenum in said housing; and a valve member fixed between said block and said inlet and discharge plenums and including an axis extending from a first point at which each of said pistons reaches the end of its inlet stroke to a second point at which each of said pistons reaches the end of its discharge stroke, at least one inlet port extending through said member on the inlet side of said axis and at least one discharge port extending through said member on the discharge side of said axis, the improvement comprising:

a plate-like element having a thickness and an axis extending from a first point at which each of said pistons reaches the end of its inlet stroke to a second point at which each of said pistons reaches the end of its discharge stroke;

at least one inlet port extending through said element on the inlet side of said axis;

at least one discharge port extending through said element on the discharge side of said axis; and pressure attenuation mens, extended through said element and positioned on the discharge side of said axis between said at least one discharge port and said first point, for providing an elongated flow path through the thickness of said element to convey hydraulic fluid between sequential trailing ones of said cylinders and said discharge plenum, flow through said elongated flow path being in parallel with flow from sequential leading ones of said cylinders through said at least one discharge port to said discharge plenum, said flow path having a length and a cross-section sufficient to permit gradual attenuation of a pressure differential between each said trailing cylinder and said discharge plenum, said gradual attenuation occurring before the cylinder port of each said trailing cylinder opens to said at least one discharge port of said element, whereby the operating noise level of said axial piston apparatus is reduced.

13. The improvement according to claim 12, wherein said length of said flow path exceeds the arc length between said first point and the leading edge of said discharge port minus one-half the arc length of one of said cylinder ports of said block, as measured about the axis of said shaft.

14. The improvement according to claim 12, wherein said length of said flow path exceeds the arc length between said first point and the leading edge of said discharge port minus one-half the arc length of one of said cylinder ports of said block, as measured about the axis of said shaft.

15. The improvement according to claim 12, wherein said plate-like element comprises a separate, removable valve plate adapted to be fixed in operation between said block and said inlet and discharge plenums.

16. The improvement according to claim 15, wherein said length of said flow path exceeds the arc length between said first point and the leading edge of said discharge port minus one-half the arc length of one of said cylinder ports of said block, as measured about the axis of said shaft.

17. The improvement according to claim 15, wherein said pressure attenuation means comprises a metering groove in the side of said member facing said block, the ends of said groove being spaced from said discharge port and said first point; a bore through said member into said groove; and an attenuation conduit attached to the opposite side of said member in communication with said bore to establish said flow path, said conduit extending into said discharge plenum.

18. The improvement according to claim 17, wherein the arc length of said metering groove is less than the arc spacing between said cylinder ports of said block, as measured about the axis of said shaft.

19. The improvement according to claim 17, wherein the arc length of said metering groove is greater than the arc spacing between said cylinder ports of said block, as measured about the axis of said shaft.

20. In a rotary axial piston apparatus of the type including a housing having an interior chamber; a shaft extending through said chamber and mounted for rotation in said housing; a cylinder block mounted for rotation with said shaft and provided with a plurality of axially extending through cylinders having cylinder ports at one end of said block; a plurality of piston assemblies, one positioned for movement in each of said cylinders; cam means mounted to said housing and operatively connected to said piston assemblies at the other end of said block, for causing said piston assemblies to reciprocate in said cylinders when said block rotates with said shaft; an inlet plenum in said housing; a discharge plenum in said housing; and a valve member fixed between said block and said inlet and discharge plenums and including an axis extending from a first point at which each of said pistons reaches the end of its inlet stroke to a second point at which each of said pistons reaches the end of its discharge stroke, at least one inlet port extending through said member on the inlet side of said axis and at least one discharge port extending through said member on the discharge side of said axis, the improvement comprising:

pressure attenuation means, positioned on the discharge side of said axis between said at least one discharge port and said first point, for providing an elongated flow path through the thickness of said element to convey hydraulic fluid between sequential trailing ones of said cylinders and said discharge plenum, said pressure attenuation means comprising a metering groove in the side of said valve member facing said block, the ends of said metering groove being spaced from said at least one discharge port and said first point, a bore through said member from said discharge plenum into said groove; and an attenuation conduit attached to the opposite side of said member in communication with said bore to establish said flow path, said conduit extending into said discharge plenum so that flow through said flow path is in parallel with flow from sequential leading ones of said cylinders through said at least one discharge port to said discharge plenum, said flow path having a length and a cross-section sufficient to permit gradual attenuation of a pressure differential between each said trailing cylinder and said discharge plenum, said gradual attenuation occurring before the cylinder port of each said trailing cylinder opens to said at least one discharge port of said valve element, whereby the operating noise level of said axial piston apparatus is reduced.

21. The improvement according to claim 20, wherein the arc length of said metering groove is less than the arc spacing between said cylinder ports of said block, as measured about the axis of said shaft.

* * * * *